US005098530A

United States Patent [19]

Sudhölter et al.

[11] Patent Number: 5,098,530

[45] Date of Patent: Mar. 24, 1992

[54] CARBON ELECTRODE WITH GASTIGHT, TEMPERATURE STABLE PROTECTIVE GLOBE

[75] Inventors: Rainer Sudhölter; Ulrich Hampel, both of Grevenbroich, Fed. Rep. of Germany

[73] Assignee: Verenigte Aluminium-Werke AG, Bonn, Fed. Rep. of Germany

[21] Appl. No.: 435,005

[22] Filed: Nov. 9, 1989

[30] Foreign Application Priority Data

Nov. 17, 1988 [DE] Fed. Rep. of Germany ..... 3838828

[51] Int. Cl.[5] ..... C25C 3/06; C25C 3/08

[52] U.S. Cl. ..... 204/67; 204/243 R; 204/279; 204/280; 204/294; 204/64 R

[58] Field of Search ..... 204/67, 243 R, 279, 204/280, 245, 294, 290 R; 373/88

[56] References Cited

U.S. PATENT DOCUMENTS 3,060,115 10/1962 Haupin et al. ..... 204/243 R
3,622,491 11/1971 Wong et al. ..... 204/225
3,829,374 8/1974 Kugler et al. ..... 204/290 R
4,002,551 1/1977 Duclaux et al. ..... 204/245
4,462,887 7/1984 Moziol et al. ..... 204/286
4,787,965 11/1988 Audras et al. ..... 204/290 R

*Primary Examiner*—John Niebling
*Assistant Examiner*—Kathryn Gorgos
*Attorney, Agent, or Firm*—Darby & Darby

[57] ABSTRACT

A carbon electrode surrounded by a protective globe in a fusion refining electrolysis process. The protective globe is self-supporting, gastight and thermally stable. The protective globe is spaced from the carbon electrode by a predetermined distance. Also, there is a predetermined distance between an end of the carbon electrode to be immersed in a melting bath and an open end of the protective globe through which projects the carbon electrode. A preheating process requires the electrode to be initially preheated over the melting bath, then its exposed end is immesered into the melting bath while not immersing the protective globe, and finally immersing both the electrode and the protective globe.

15 Claims, 3 Drawing Sheets

CARBON ELECTRODE WITH GASTIGHT, TEMPERATURE STABLE PROTECTIVE GLOBE

BACKGROUND OF THE INVENTION

The present invention relates to an apparatus for use in fusion refining electrolysis. The apparatus includes a carbon electrode surrounded by a self-supporting, gastight, and temperature stable protective globe.

In fusion refining electrolysis, such as, for example, three-layer electrolysis for refining aluminum as cathodes, carbon electrodes which are used are usually of graphitized carbon. These electrodes are immersed directly in the molten cathode metal. The carbon material vitrifies above the upper surface of the molten bath very vigorously, because of the high temperature of the electrodes and the unblocked admission of atmospheric oxygen.

As a consequence, the cross-section of the electrode can be so greatly reduced that the under part of the electrode breaks off. This leads to a high carbon material consumption of about 8% with respect to the amount of metal produced. In order to reduce this high carbon material consumption, the admission of atmospheric oxygen must be stopped. Up to now, various methods have been proposed.

Through impregnation of the carbon electrodes, for example, with borax or phosphates, the carbon material consumption can be reduced to about 4%. In this case, the cathode metal becomes contaminated by the impregnation agent.

Coating or casting around the carbon electrode with already refined aluminum offers inadequate protection against oxygen. The aluminum can melt away at the given temperatures of the electrode upper surface so that the carbon material burns off beneath the protective layer.

As another proposal, the carbon electrodes are given a several mm thick ceramic layer, for example, by means of a plasma spray. Unfortunately, the different thermal expansion rates of carbon and ceramic leads to thermal stress and thereby deterioration of the ceramic layer.

It would, therefore, be desirable to protect a carbon electrode effectively to endure despite oxygen admission so that the consumption of the carbon material is at most 1% and no contamination enters the cathode metal. The loss in carbon material due to consumption is related to the produced amount of refined aluminum, subject to burning losses and losses from break off of parts of the electrodes.

SUMMARY OF THE INVENTION

The present invention is directed to a carbon electrode surrounded by a self-supporting protective globe made out of an at least gastight, temperature stable material. By "self-supporting" it should be understood with respect to the protective globe, which is supported a distance away from the electrode also by a supporting device. The electrode and protective globe immersed together in the cathode metal so that the electrode is completely isolated from the atmosphere.

The protective globe must be self-supported and not be allowed to densely rest against the electrode, because the protective globe will become thermally stressed by means of differences in the thermal expansion rates of carbon and ceramic which takes place during temperature changes. In order to accommodate the thermal expansion, the gap between the cathode surface of the electrode and the inner surface of the protective globe is recommended to be a distance of at least 1 mm. If the distance is less than this value, a danger arises that the metal melting bath will rise up into the gap by means of capillary action and then solidify in cold areas. This can lead to thermal stressing of the protective globe or reduce the reusability of the globe.

The ceramic for the protective globe material may thermally expand at high temperatures, but it should not crack by thermal stresses or in combination with mechanical stresses. Furthermore, it should be in a stable form at the normally used temperatures.

As a suitable material for the protective globe, $Al_2O_3$-ceramic with an $Al_2O_3$-content of $\geqq 99.7\%$ by weight and an overall porosity of $\leqq 5\%$ has been found to be sufficiently dense in order to block the admission of atmospheric oxygen. The high purity assures that no contamination in the cathode metal will take place. For good mechanical stability for the assembly and handling of the protective globe, a minimum wall thickness of 5 mm is required.

High $Al_2O_3$-content is necessary to keep low contamination of refined aluminum melt which is in contact with the globe material. If $Al_2O_3$-content is less than 99.7%, the risk and the amount of contamination is high.

The porosity through the globe should be very low to minimize the diffusion of oxygen through the pores and thus to minimize oxidation of the graphite electrode. On the other hand, a certain porosity is necessary for high resistance to sudden changes of temperature and thus to prevent cracking or destroying of the globe material by thermal stresses. With a maximum porosity of 5%, the portion of permeable porosity (which is only a very small portion of the overall porosity) is low enough to keep a very low carbon consumption rate.

The protective globe must be preheated to avoid damage, despite its comparatively high thermal shock stability during the immersion in the melting bath. In accordance with a preferred embodiment of the present invention, an economical preheat can be effected directly in the electrolysis furnace. For this, the protective globe does not surround the entire shell surface of the carbon electrode; rather, it stops a predetermined distance from the immersed side of the electrode in the melting bath. This distance is at least 10 mm. The entire electrode is brought into the electrolysis furnace and heated over the melting bath for a period from 6 to 10 hours. Thereafter, the under part of the carbon electrode is immersed in the melting bath, but so that the protective globe still has no direct contact with the melting bath. In this position, the electrode is further, heated for a period of 6 to 10 hours. Finally, the electrode is lowered until the protective globe also immerses in the melting bath. The maximum distance between the electrode nd underside of the globe will be limited by the height of the layer of the molten cathode metal. It is recommended that the distance not substantially exceed a value of 30 mm.

The amount of cathode metal in the cell varies with the amount of the periodically withdrawn product metal. Also, there is a certain movement in the cathode metal at any time. For these reasons, the height of the cathode metal is not constant. For the preferred use of the invention, it is necessary that the globe be immersed into the cathode metal. On the other hand, the graphite electrode should not have any contact with the electrolyte. If the maximum distance between undersides of the graphite electrode and the globe is 30 mm, these conditions can be satisfied in any case.

The carbon electrodes in accordance with the invention will preferably be graphite and be in cylindrical form. The cylindrical form is preferred for manufacturing reasons. Furthermore, the cylindrical form has low risk of cracking as there are no notch effects. They can advantageously be used as cathodes in a fusion refining electrolysis process, although their use as anodes is also possible. In particular, they can be employed as cathodes for the three-layer fusion refining electrolysis of aluminum. In this case, the carbon material consumption will lessen by about 1%, relative to the amount of produced metal. The consumption is about 10 kg graphite for the production of 1 metric ton (i.e., 1000 kilograms) aluminum. Further advantages of the invention are long useful life and reusability of the protective globe due to the avoidance of contamination of the cathode material.

For a better understanding of the present invention, reference is made to the following description and accompanying drawings while the scope of the invention is set forth in the appended claims.

FIGS. *7a–c* are progressive elevational views of the carbon electrode with protective globe being inserted into a melting bath.

Figure 8:
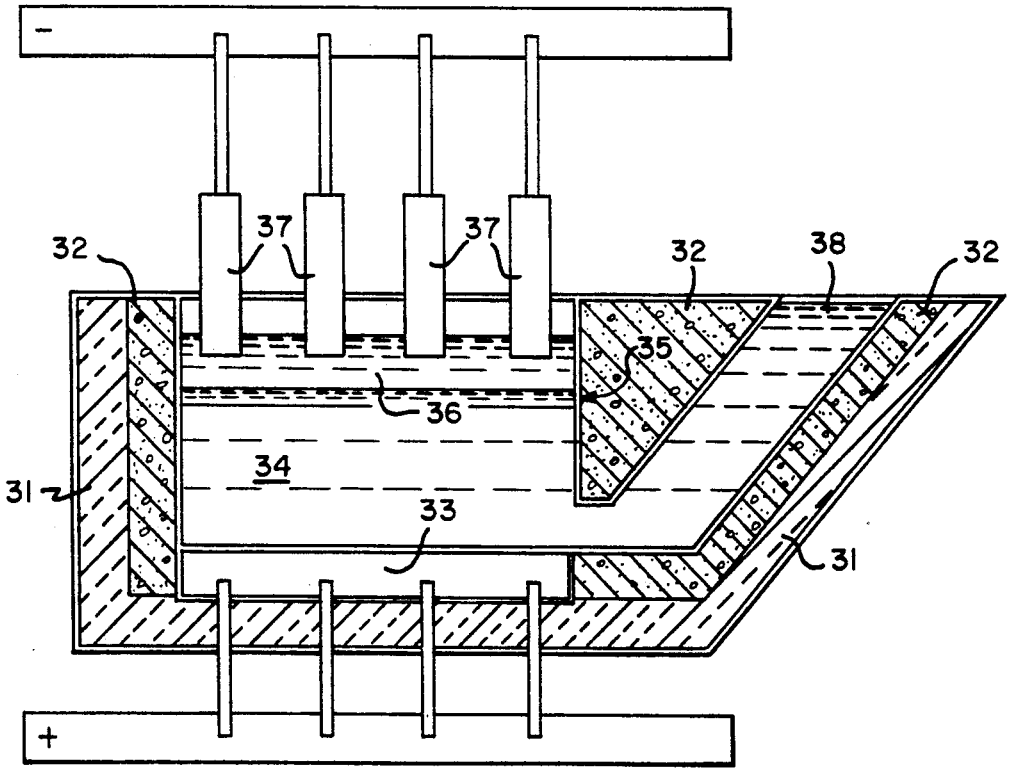
FIG. 8 PRIOR ART

FIG. 8 is a schematic elevational view of the carbon electrode with protective globe being employed as a cathode for fusion refining electrolysis of aluminum.

DESCRIPTION OF THE PREFERRED EMBODIMENT

Figure 1:
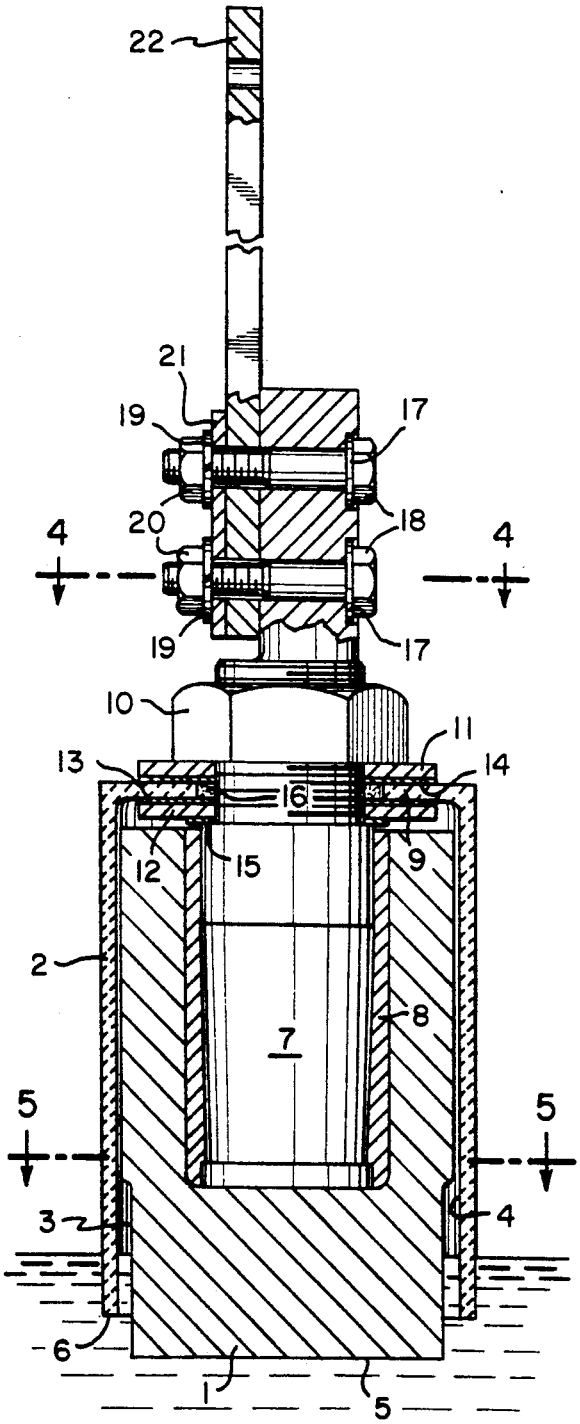
FIG. 1 is a partial cross-section of the carbon electrode and protective globe in accordance with the present invention that is inserted into a melting bath.

Turning to the drawings, FIG. 1 shows an assembly of a carbon electrode with ceramic protective globe. The carbon electrode 1 is cylindrically shaped. A copper nipple 7, which is stamped by means of a graphite stamping mass 8 in the electrode, is of high electric conductivity and is on the charged side of the carbon electrode 1. The stamping mass 8 consists of graphite particles and an organic binder. This mixture is pressed between graphite electrode and copper nipple and then sintered.

The protective globe 2 is made from an $Al_2O_3$-ceramic with an $Al_2O_3$-content of $\geqq 99.7\%$ by weight and an overall porosity of $\leqq 5\%$.

Globe 2 is pipe-shaped and arranged concentrically about the carbon electrode 1. The protective globe 2 has an end formed as a rotary collet 9, which projects radially inward. The fastening of the protective globe 2 takes place by means of screwing of the collet 9 and of the copper nipple 7 by means of a nut 10. The screwing is made tight about steel thrust washers 11, 12 with temperature stable sealing rings 13, 14, 15, which may be made from aluminum silicate fiber material, and jointing compounds 16, which may be aluminum silicate cement with aluminum silicate fibers.

The sealing rings should be stable at least up to 800° C. to prevent penetration of oxygen.

The higher thermal expansion of the copper nipple is compensated by jointing compound 16.

The distance between the electrode cover 3 and the inner surface 4 of the protective globe 2 is 1–5 mm. On the immersed side in the melting bath projects the carbon electrode from the protective globe 2. The distance between the electrode underside 5 and the underside 6 of the protective globe is preferably 30 mm maximum.

Figure 2:
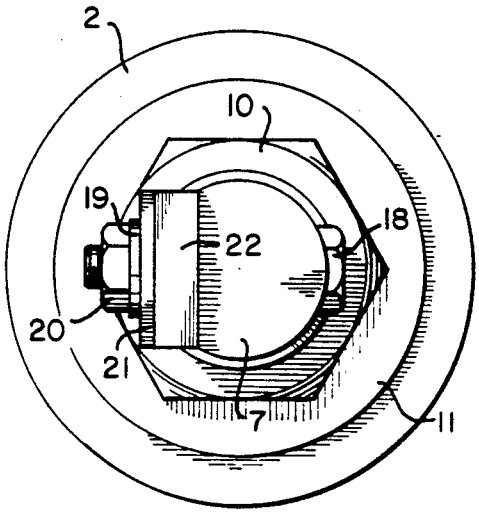
FIG. 2 is a top view of the carbon electrode with protective globe of FIG. 1.

In order to support the carbon electrode with protective globe for hanging, FIGS. 1 and 2 show the copper nipple 7 having an end with two through-going holes into which are inserted steel screws 18. This end has a semicircular cross-section. A steel hanging element 22 is provided with two through-going holes as well, through which the screws 18 are also inserted. A steel fastening plate 21 is also provided with two holes also, through which the screws 18 are inserted. A washer 17 is between the head of each screw 18 and the holes on the end of the copper nipple 7. Washer 19 and nut 20 secure the threaded end of the screw 18 to the fastening plate 21.

After the steel hanging element 22 is secured in place between the fastening plate 21 and flat side of the semicircular end of the copper nipple 7, the hanging element 22 can be freely hung by its opposite end through a hole formed therein. This support arrangement is advantageous in that a common support bar can be used for hanging a plurality of carbon electrodes with protective globes at the same elevation.

Figure 3:
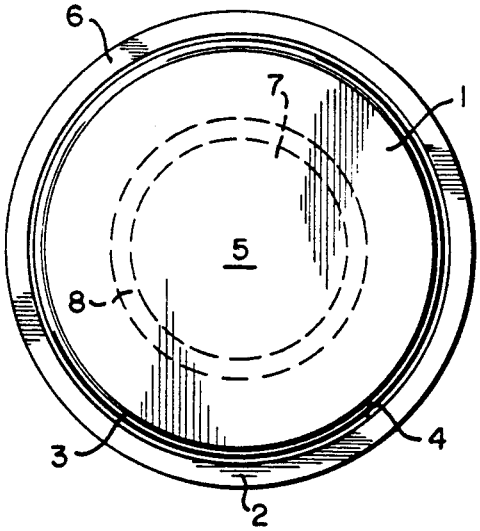
FIG. 3 is a bottom view of the carbon electrode with protective globe of FIG. 1.
Figure 4:
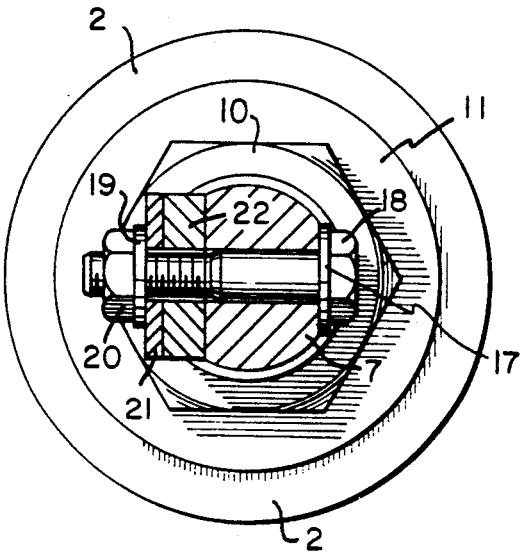
FIG. 4 is a cross-section taken along section lines 4—4 of FIG. 1.
Figure 5:
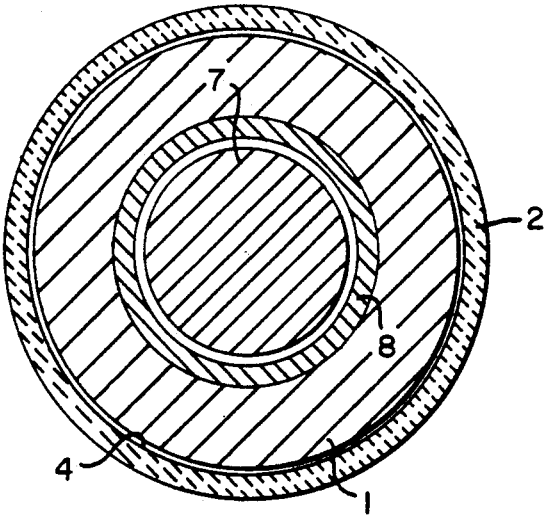
FIG. 5 is a cross-section taken along section lines 5—5 of FIG. 1.

FIGS. 3–5 depict additional views of the carbon electrode with protective globe at other elevations, showing the continuous cylindrical shape free of notches.

Figure 6:
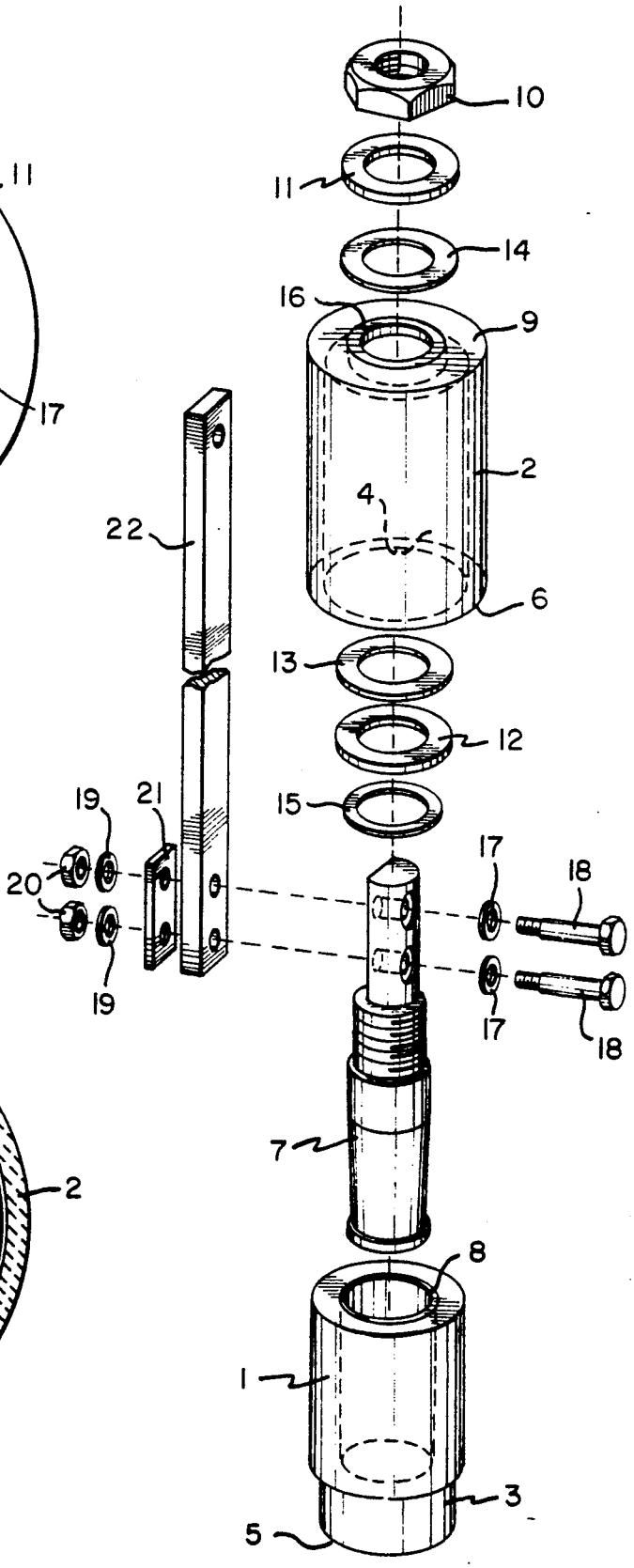
FIG. 6 is an exploded perspective view of the carbon electrode with protective globe of FIG. 1.
Figure 7A:
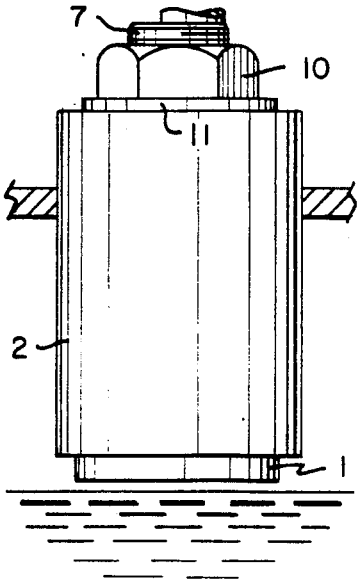
Figure 7B:
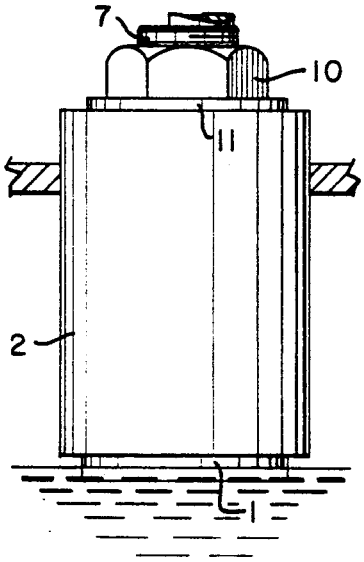
Figure 7C:
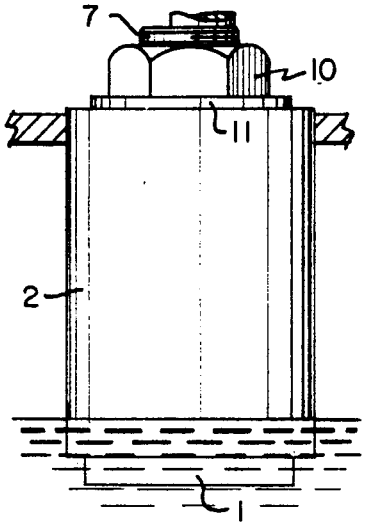

The manner in which the carbon electrode with protective globe is to be assembled is readily understood from the exploded view of FIG. 6. The hanging support element 22 with support plate 21 and screws 17,18 (and miscellaneous washers and nuts) are put on last.

FIGS. *7a–c* show the method of preheating the carbon electrode with protective globe in a melting bath of an electrolysis furnace. FIG. *7a* shows the preheating of the electrode over the melting bath (for a period of 6 to 10 hours). FIG. *7b* shows the immersing of an under part of the electrode in the melting bath so that it heats up without there being any direct contact between the protective globe and melting bath (this takes place for 6 to 10 hours). FIG. *7c* shows the electrode after being lowered further into the bath so that the end of the carbon electrode also immerses in the melting bath.

The time period for the duration of the preheating steps (i.e., 6 to 10 hours) is only an approximate range. If the time period is too long, the risk and the amount of carbon losses due to burning off increases, because the carbon electrode is not protected from oxygen during the preheating steps.

FIG. 8 shows an arrangement for a three-layer fusion refining electrolysis of aluminum in accordance with the prior art. There is insulation 31, masonry 32, a carbon base 33, an anode 34, an electrolyte 35, a cathode 36, graphite electrodes 37 (without any protective globe) and a fire hearth or receiver 38.

Carbon electrodes with protective globes as in FIG. 1 are substituted for the graphite electrodes shown in FIG. 8, because they are used in the same manner for effecting electrolysis. Preferably, the carbon electrodes with protective globe of FIG. 1 is preheated in the manner illustrated in FIGS. *7a–b* prior to the immersion shown in FIG. 8. The carbon electrode is used as a cathode.

While the foregoing description and drawings represent the preferred embodiments of the present invention, it will be understood that various changes and modifications may be made without departing from the spirit and scope of the present invention.

What is claimed is:

1. An apparatus for fusion refining electrolysis, comprising:

a carbon electrode having an underside immersed in a melting bath; and means for protecting said carbon electrode from contamination caused by exposure to atmospheric oxygen during immersion of said carbon electrode in the melting bath as part of a process of fusion refining electrolysis, said protecting means including a self-supporting and gas tight protective globe radially surrounding said carbon electrode, said globe having an underside of an end immersed in said melting bath, said globe being spaced from said carbon electrode and not being supported by said carbon electrode.

2. An apparatus as in claim 1, wherein said protective globe is substantially composed of $Al_2O_3$ with an $AL_2O_3$-content of $\geqq 99.7\%$ by weight.

3. An apparatus as in claim 1, wherein said protective globe is composed of material having an overall porosity of a maximum of 5%.

4. An apparatus as in claim 1, wherein said carbon electrode has an outer surface arranged relative to an inner surface of the protective globe so that a distance therebetween is from 1 to 5 mm.

5. An apparatus as in claim 1, wherein said protective globe has a wall thickness of at least 5 mm.

6. An apparatus as in claim 1, wherein said carbon electrode and said protective globe each have a cylindrical shape.

7. An apparatus as in claim 1, wherein a distance between the underside of the immersed end of said carbon electrode in the melting bath and an underside of said protective globe is at least 10 mm.

8. An apparatus as in claim 1, further comprising a common support attached to said globe and to said carbon electrode.

9. An apparatus as in claim 8, further comprising means for enabling having of said common support and thereby of said globe and said carbon electrode.

10. An apparatus as in claim 1, further comprising a copper nipple and a mass of graphite particles and organic binder, said mass being radially between said copper nipple and said carbon electrode.

11. An apparatus as in claim 1, further comprising means for effecting fusion refining processing, said effecting means including said carbon electrode and said melting bath.

12. A process for preheating a carbon electrode for use in fusion refining electrolysis, the carbon electrode being surrounded by a self-supporting and gas tight protective globe so that a distance between an underside of an immersed end of the electrode in a melting bath and an underside of the protective globe is at least 10 mm, the globe being spaced from the carbon electrode and not being supported by said carbon electrode, the process of preheating taking place directly in an electrolysis furnace and comprising the steps of:

a) preheating the electrode in the furnace over the melting bath for a period of 6 to 10 hours;

b) immersing the underside of the carbon electrode in the melting bath and heating up without direct contact of the protective globe with melting bath for a period of 6 to 10 hours; and c) protecting the electrode from contamination caused by exposure to atmospheric oxygen during immersion of the electrode in the melting bath as part of a process of fusion refining electrolysis, the step of protecting including further lowering the electrode until immersing the protective globe in the melting bath.

13. A process employing a carbon electrode surrounded by a self-supporting and gas tight protective globe, the globe being spaced from the carbon electrode and not being supported by the carbon electrode, the process comprising the steps of:

fusion refining electrolysis processing; and using the electrode as a cathode in the step of fusion refining electrolysis processing.

14. A process as in claim 13, wherein the step of fusion refining processing is for a three-layer electrolysis for refining of aluminum.

15. A process as in claim 13, further comprising immersing undersides of the globe and electrode in a melting bath.

* * * * *